US011098712B2

(12) United States Patent
Terada

(10) Patent No.: US 11,098,712 B2
(45) Date of Patent: Aug. 24, 2021

(54) GEAR PUMP

(71) Applicant: TBK Co., Ltd., Tokyo (JP)

(72) Inventor: Yoshiyuki Terada, Tokyo (JP)

(73) Assignee: TBK Co., Ltd., Tokyo (JP)

( * ) Notice: Subject to any disclaimer, the term of this patent is extended or adjusted under 35 U.S.C. 154(b) by 48 days.

(21) Appl. No.: 16/646,541

(22) PCT Filed: Oct. 5, 2017

(86) PCT No.: PCT/JP2017/036232
§ 371 (c)(1),
(2) Date: Mar. 11, 2020

(87) PCT Pub. No.: WO2019/069418
PCT Pub. Date: Apr. 11, 2019

(65) Prior Publication Data

US 2020/0277953 A1 Sep. 3, 2020

(51) Int. Cl.
*F04C 2/10* (2006.01)
*F04C 11/00* (2006.01)
*F04C 15/06* (2006.01)

(52) U.S. Cl.
CPC ..... *F04C 2/102* (2013.01); *F04C 11/003* (2013.01); *F04C 15/06* (2013.01); *F04C 2/10* (2013.01)

(58) Field of Classification Search
CPC ..... F04C 2/102; F04C 11/003; F04C 2/10; F04C 15/06; F04C 15/0042;
(Continued)

(56) References Cited

U.S. PATENT DOCUMENTS

2018/0209416 A1 7/2018 Araki et al.

FOREIGN PATENT DOCUMENTS

DE 38 04 633 A1 8/1989
WO WO-9919606 A1 * 4/1999 ..... F04C 2/107
WO 2016/185503 A1 11/2016

OTHER PUBLICATIONS

International Search Report issued in PCT/JP2017/036232; dated Dec. 12, 2017.

(Continued)

*Primary Examiner* — Connor J Tremarche
(74) *Attorney, Agent, or Firm* — Studebaker & Brackett PC

(57) ABSTRACT

A gear pump comprises an internal gear (10), a first external gear (20) and a second external gear (30), a case member (50) having a one end side accommodation portion (52) for retaining these gears (10,20,30), an other end side accommodation portion (53) at other end side and a partition wall portion (54) therebetween, a cover member (70) and a plate member (80). A pump chamber (P) defined inside the internal gear (10) is divided into a first pump chamber (P1) which has a first intake-discharge space (L1) and a first discharge-intake space (H1), and a second pump chamber (P2) which has a second intake-discharge space (L2) and a second discharge-intake space (H2). The plate member has a first communication path (81) and a second communication path (82) between the plate member (80) and the cover member (70). The one side communication passage (57) is communicated with the first communication path (81). Two penetrating holes (82*b*,82*c*) are formed on the plate member (80). An other side communication passage (82*a*), which communicate the two penetrating holes (82*b*,82*c*) with each other, is formed between the plate member (80) and the cover member (70).

4 Claims, 7 Drawing Sheets

(58) Field of Classification Search
CPC ..... F04C 15/0069; F04C 2210/206; F04C 2/101; F04C 11/001
See application file for complete search history.

(56) References Cited

OTHER PUBLICATIONS

The extended European search report issued by the European Patent Office dated Jan. 12, 2021, which corresponds to European Patent Application No. 17927886.6-1004 and is related to U.S. Appl. No. 16/646,541.

* cited by examiner

GEAR PUMP

TECHNICAL FIELD

The present invention relates to a gear pump pressure-sending a fluid in response to rotation of a gear.

TECHNICAL BACKGROUND

Conventionally, a gear pump has been known as a pump supplying oil for effecting lubrication, operation, etc. on various apparatuses provided in a vehicle or the like (See, for example, Patent Document 1). The gear pump described in the abovementioned patent document is equipped with an internal gear formed in an annular configuration and having internal teeth, a pair of external gear (a first external gear and a second external gear) arranged on the inner peripheral side of the internal gear and having external teeth capable of mesh-engagement with the internal teeth, a case member rotatably accommodating and retaining the internal gear and the external gears, and a cover member having an intake port and a discharge port. In the above-described gear pump, a first intake space and a first discharge space are defined between the inner peripheral surface of the internal gear and the outer peripheral surface of the first external gear, and a second intake space and a second discharge space are defined between the inner peripheral surface of the internal gear and the outer peripheral surface of the second external gear. This gear pump takes a fluid from the intake port into the first intake space and the second intake space, and discharges the fluid from the first discharge space and the second discharge space to the discharge port in accordance with the rotation of the internal gear and the external gears.

PRIOR ARTS LIST

Patent Document

Patent Document 1: PCT International Application No. 2016/185503(A1)

SUMMARY OF THE INVENTION

Problems to be Solved by the Invention

In the above-described gear pump, it is necessary to adopt a structure in which the oil flow path is branched off from one intake port into the two intake spaces and in which the oil flow path is joined from the two discharge spaces with one discharge port, and a plurality of plate members forming this oil flow path is provided between the cover member and the case member. From the viewpoint of production, it is difficult to form the intake side oil path (branching-off oil path) connecting the intake port and the intake spaces and the discharge side oil path (joining oil path) connecting the discharge port and the discharge spaces solely by a single plate member without involving mutual crossing, so that these oil paths are formed by combining a plurality of plate members. In recent years, however, it is necessary to form the plate members thin to meet a demand for a reduction in the thickness of the gear pump, so that the oil path area formed in each plate member is so much the smaller, resulting in an increase in oil pressure loss and deterioration in pump performance.

The present invention has been made in view of the abovementioned problem. It is an object of the present invention to provide a gear pump capable of suppressing a reduction in pressure loss while securing the requisite fluid flow path area.

Means to Solve the Problems

To achieve the abovementioned object, there is provided, in accordance with the present invention, a gear pump including: an internal gear formed in an annular configuration and having internal teeth on an inner peripheral side; a first external gear and a second external gear having on an outer peripheral side external teeth capable of mesh-engagement with the internal teeth and arranged on the inner peripheral side of the internal gear; a case member having at one end side in an axial direction a one end side accommodation portion rotatably accommodating and retaining the internal gear, the first external gear, and the second external gear and having at other end side in the axial direction other end side accommodation portion; a cover member mounted to the case member and closing an opening of the other end side accommodation portion; and a plate member accommodated in the other end side accommodation portion of the case member, a pump chamber being defined inside the one end side accommodation portion and on the inner peripheral side of the internal gear, wherein the case member has a partition portion dividing the pump chamber into a first pump chamber arranged on a side of the first external gear and a second pump chamber arranged on a side of the second external gear; the first pump chamber has a first intake space taking in a fluid and a first discharge space discharging the fluid in accordance with rotation of the internal gear and the first external gear; the second pump chamber has a second intake space taking in the fluid and a second discharge space discharging the fluid in accordance with rotation of the internal gear and the second external gear; the first intake space, the second intake space, the first discharge space, and the second discharge space communicate with the other end side accommodation portion; the cover member has a first port and a second port; the plate member has a first communication path communicating with the first port and a second communication path communicating with the second port; the case member has a one side communication portion communicating with each of one set of spaces of a set of the intake spaces and a set of the discharge spaces in the other end side accommodation portion; the first communication path communicates with the one side communication portion; and the second communication path has an other side communication portion communicating with each of the other set of spaces of the set of the intake spaces and the set of the discharge spaces.

In the gear pump of the present invention, it is preferable that the other side communication portion have two communication holes formed so as to axially extend through the plate member, and a communication groove open at the other end side in the axial direction of the plate member and communicating with the two communication holes, and the two communication holes communicate with the other set of spaces.

Further, in the gear pump of the present invention, it is preferable that the first intake space and the second intake space be arranged symmetrically with respect to a rotation center of the internal gear, and that the first discharge space and the second discharge space be arranged symmetrically with respect to the rotation center of the internal gear.

In addition, in the gear pump of the present invention, it is preferable that the first port be an intake port for taking in the fluid, that the second port be a discharge port for discharging the fluid, that the fluid from the intake port be distributed to the first intake space and the second intake space at the one side communication portion, and that the fluid from the first discharge space and the second discharge space be joined at the other side communication portion to be sent to the discharge port.

Advantageous Effects of the Invention

In the gear pump of the present invention, of the intake side and discharge side flow path structures, the one side communication portion establishing communication between one set of spaces of the set of the intake spaces and the set of the discharge spaces and the other side communication portion establishing communication between the other set of spaces of the set of the intake spaces and the set of the discharge spaces, are separately formed on the case member and the plate member, whereby it is possible to realize, by using solely a single plate member, a flow path structure which distributes the fluid from a single port (intake port) to a plurality of intake spaces and joins the fluid from a plurality of discharge spaces at a single port (discharge port). Thus, in the gear pump according to the present invention, this plate member is formed in a large thickness (corresponding to a plurality of conventional plate members), and it is possible to secure a larger flow path area than that in the prior art, so that it is possible to reduce the pressure loss of the fluid, and to achieve an improvement in terms of pump performance.

DESCRIPTION OF THE EMBODIMENTS

Figure 1:
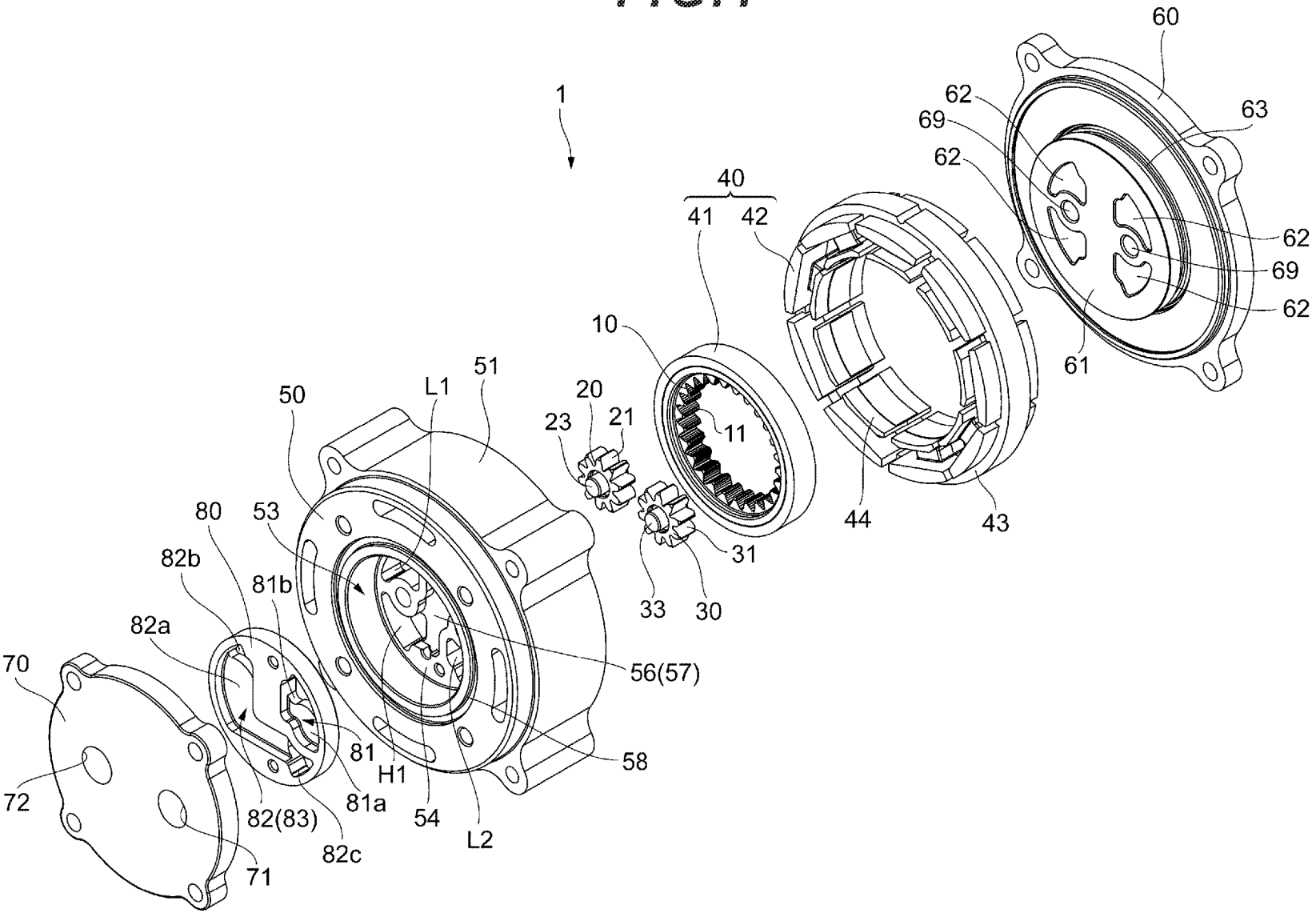
FIG. 1 is an exploded perspective view, as seen from the front side, of a gear pump according to an embodiment.
Figure 2:
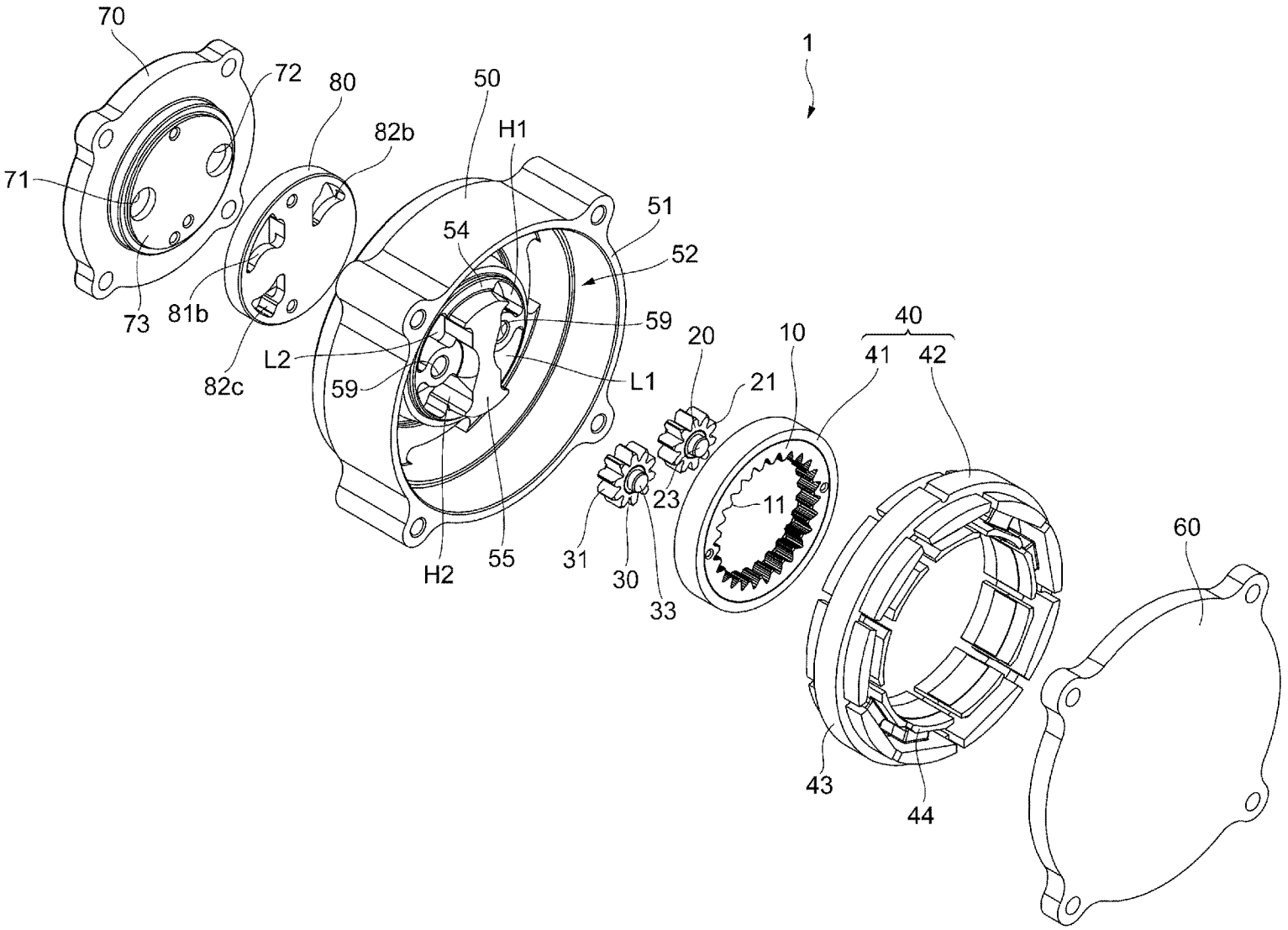
FIG. 2 is a perspective view, as seen from the rear side, of the gear pump.

In the following, a preferred embodiment of the present invention will be described with reference to the drawings. A gear pump 1 according to an embodiment of the present invention is formed as an electric oil pump to be applied to a vehicle hydraulic apparatus or the like. First, the general structure of the gear pump 1 of the present embodiment will be described with reference to FIGS. 1 to 7.

The gear pump 1 is mainly formed by an internal gear 10 having internal teeth 11, a first external gear 20 having external teeth 21 formed so as to be capable of mesh-engagement with the internal teeth 11, a second external gear 30 having external teeth 31 formed so as to be capable of mesh-engagement with the internal teeth 11, an electric motor 40 serving as a drive source for rotating the gears 10, 20, and 30, a case member 50 accommodating and retaining the gears 10, 20, 30, and the electric motor 40, a body member 60 closing an opening at one end side of the case member 50, a cover member 70 closing an opening at the other end side of the case member 50, and a plate member 80 provided between the case member 50 and the cover member 70. In the present embodiment, the front-rear direction of the gear pump 1 will be defined as follows: the side where the cover member 70 is situated will be referred to as the front side of the gear pump 1, and the side where the body member 60 is situated will be referred to as the rear side of the gear pump 1.

The internal gear 10 is an annular gear having a plurality of internal teeth 11 formed in the peripheral direction, and is provided so as to be rotatable around a center O. On the inner peripheral side (annular inner portion) of this internal gear 10, there are arranged a first external gear 20 and a second external gear 30. On the outer peripheral side of the internal gear 10, there is integrally provided a motor rotor 41 serving as the rotor of the electric motor 40.

Figure 3:
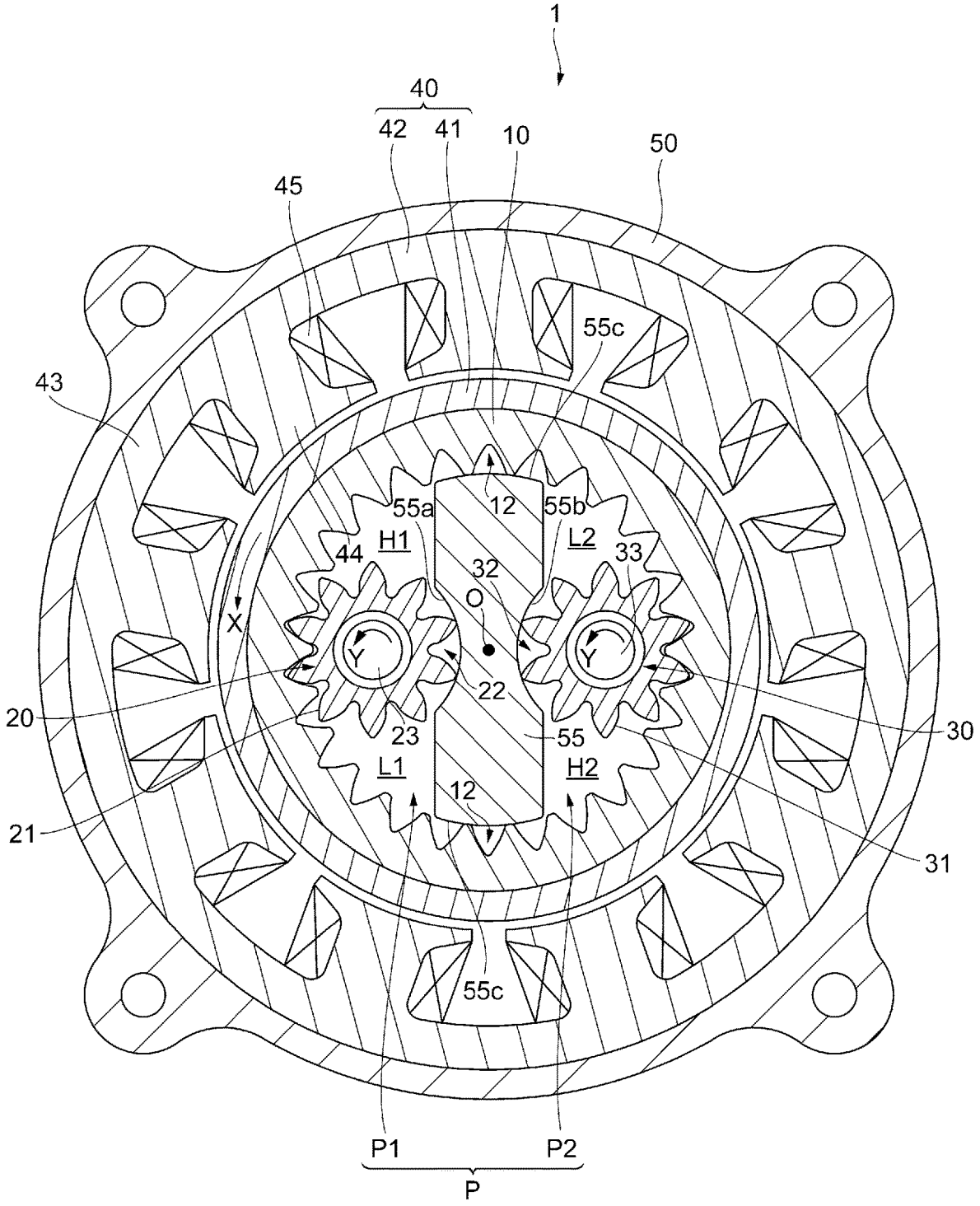
FIG. 3 is a sectional view of the gear pump.
Figure 4:
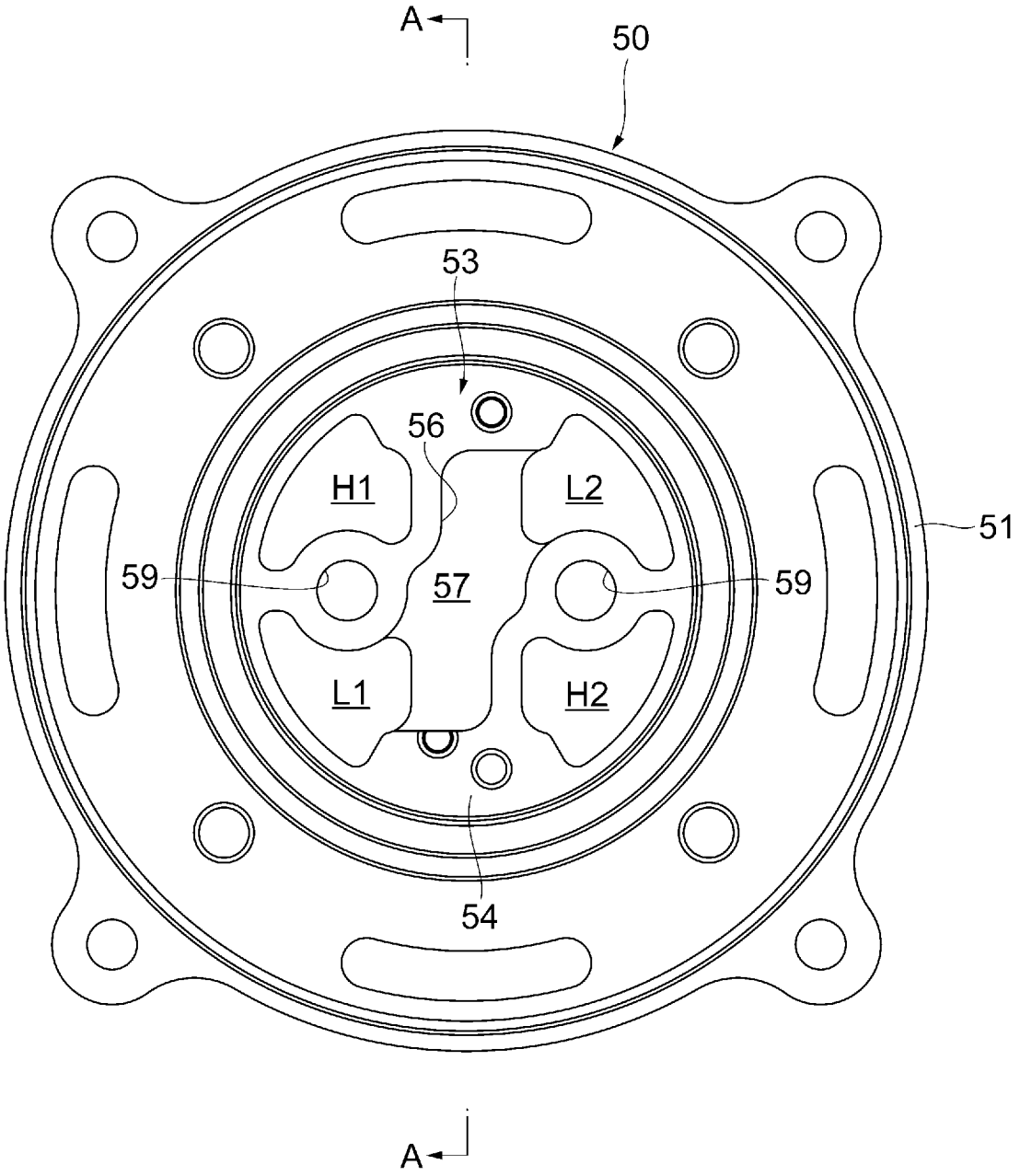
FIG. 4 is a front view of a case member of the gear pump.
Figure 5:
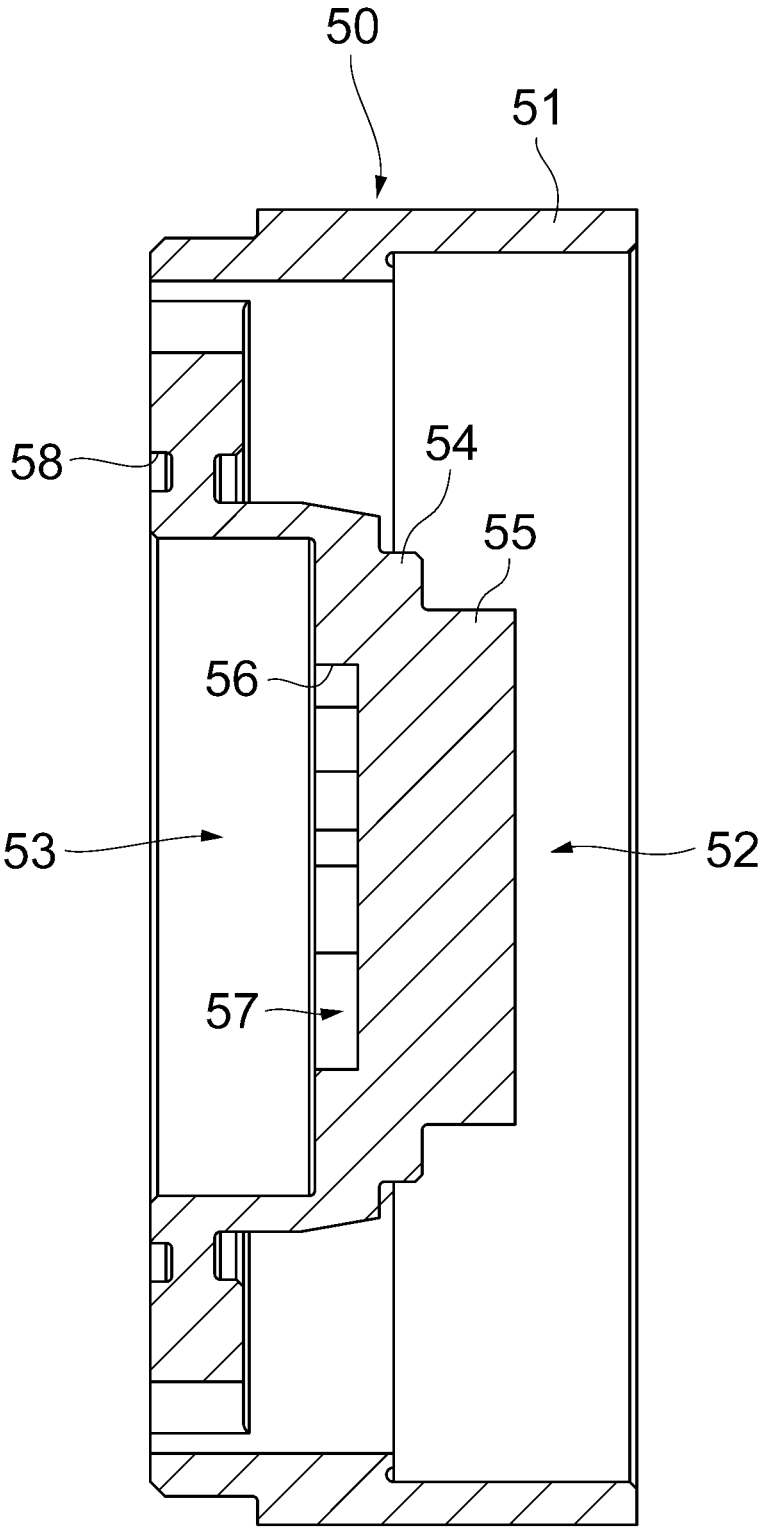
FIG. 5 is a sectional view taken along the arrow A-A of FIG. 4.
Figure 6:
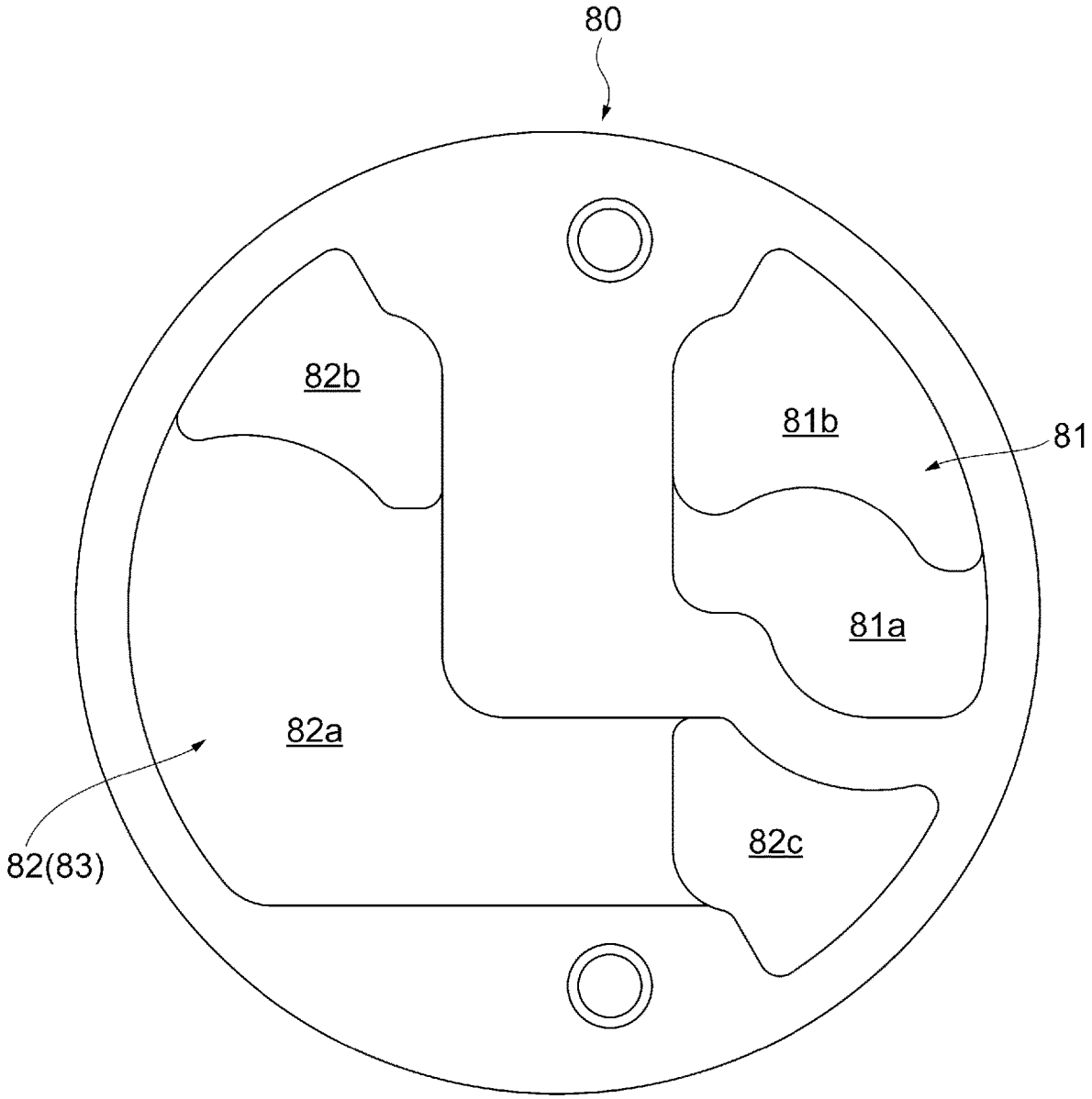
FIG. 6 is a front view of a plate member of the gear pump.
Figure 7:
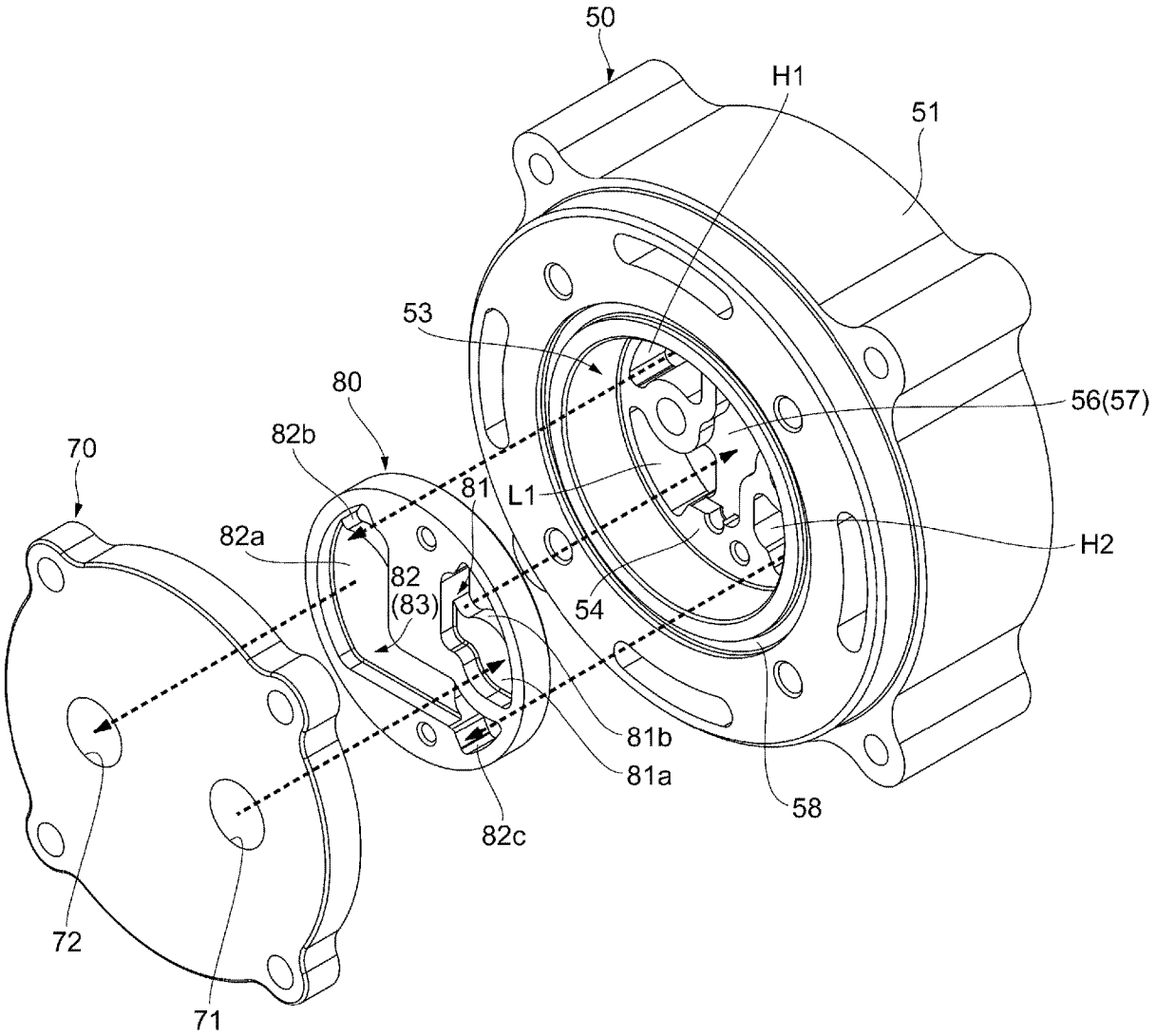
FIG. 7 is a perspective view for illustrating the oil flow in the gear pump.

The external gears 20 and 30 are spur gears on which a plurality of external teeth 21 and 31 are formed in the peripheral direction, and which are provided so as to be rotatable around axes parallel to each other. The first external gear 20 and the second external gear 30 are arranged on the inner peripheral side of the internal gear 10 in a positional relationship symmetrical with respect to the axis O of the internal gear 10. In FIG. 3, the first external gear 20 is arranged on the left side of the axis O, and the second external gear 30 is arranged on the right side of the axis O. The first external gear 20 is connected to a first shaft portion 23 via a bearing member (bearing), and is rotatable around the first shaft portion 23. Similarly, the second external gear 30 is connected to a second shaft portion 33 via a bearing member (bearing), and is rotatable around the second shaft portion 33. In each of the shaft portions 23 and 33, one axial end portion is supported by an axial hole 59 of the case member 50, and the other axial end portion is supported by an axial hole 69 of the body member 60. The external gears 20 and 30 are formed in the same structure (the same sectional configuration).

The electric motor 40 is a brushless motor equipped with the motor rotor 41 provided on the outer peripheral surface of the internal gear 10 and rotating integrally with the internal gear 10, and a motor stator 42 mounted to the inner peripheral surface of the case member 50 and arranged on the outer peripheral side of the motor rotor 41. This electric motor 40 is rotation-controlled by a control board (driver device) (not shown) mounted in the gear pump 1. The motor rotor 41 is an annular magnet having a plurality of magnetic poles in the peripheral direction, and is provided coaxially with the axis O of the internal gear 10. Arranged on the motor rotor 41 are a plurality of permanent magnets of S- and N-poles at equal intervals in the peripheral direction and alternately through multipolar magnetization. The motor stator 42 is formed by winding a coil 45 (See FIG. 3) around each of a plurality of teeth 44 provided on an annular stator core 43. When an electric current flows through the coils 45 of this motor stator 42 to generate a rotating magnetic field, due to the electromagnetic induction between the coils 45 and the motor rotor 41, a rotational force is generated in the motor rotor 41, making it possible to rotate the internal gear 10. Between the inner peripheral surface of the motor stator 42 and the outer peripheral surface of the motor rotor 41, there is provided a gap slight enough not to cause mutual contact during rotation.

The case member 50 is formed in a cylindrical configuration the front and rear ends of which are open by using a metal material such as aluminum alloy. The case member 50 is equipped with a cylindrical case main body portion 51, a rear side accommodation portion 52 recessed at the rear end portion of the case main body portion 51, a front side accommodation portion 53 recessed at the front end portion of the case main body portion 51, and a partition wall portion 54 dividing the hollow space of the case main body portion 51 into the rear side accommodation portion 52 and the front side accommodation portion 53.

The rear side accommodation portion 52 is a cylindrical accommodation space accommodating the gears 10, 20, and 30, and the electric motor 40. In the rear side accommodation portion 52, the internal gear 10 and a pair of external gears 20 and 30 are arranged in a mutually mesh-engaged state. In this rear side accommodation portion 52, on the inner peripheral side of the internal gear 10, there is defined a pump chamber P for taking in and discharging oil. The pump chamber P is divided into a plurality of chambers by a protruding partition portion 55 formed at the rear surface side of the partition wall portion 54.

The partition portion 55 has an arcuately recessed first peripheral surface 55*a* having a curvature substantially equal to that of the tooth distal end diameter (outer diameter) of the first external gear 20 and formed so as to be capable of bringing the external teeth 21 into slide contact therewith, an arcuately recessed second peripheral surface 55*b* having a curvature substantially equal to that of the tooth distal end diameter (outer diameter) of the second external gear 30 and formed so as to be capable of bringing the external teeth 31 into slide contact therewith, and a pair of arcuately protruded third peripheral surfaces 55*c* having a curvature substantially equal to that of the tooth distal end diameter (inner diameter) of the internal gear 10 and formed so as to be capable of bringing the internal teeth 11 into slide contact therewith.

Respectively formed in the tooth grooves of the gears 10, 20, and 30 are inter-tooth spaces 12, 22, and 32 filled with oil to be pressure-sent. The inter-tooth space 12 of the internal gear 10 is closed between itself and the third peripheral surface 55*c* of the partition portion 55. The inter-tooth space 22 of the first external gear 20 is closed between itself and the first peripheral surface 55*a* of the partition portion 55. The inter-tooth space 32 of the second external gear 30 is closed between itself and the second peripheral surface 55*b* of the partition portion 55. The front side surfaces of the gears 10, 20, and 30 are in slide contact with the rear end surface of the partition wall portion 54, and the rear side surfaces of the gears 10, 20, and 30 are in slide contact with the front end surface of the body member 60. In this way, the gears 10, 20, and 30 are held between the case member 50 and the body member 60, whereby movement in the axial direction (front-rear direction) is regulated in the rear side accommodation portion 52, and side surface sealing is effected.

The pump chamber P is divided into a first pump chamber P1 arranged on the first external gear 20 side and a second pump chamber P2 arranged on the second external gear 30 side by the partition portion 55 of the partition wall portion 54. In FIG. 3, the first pump chamber P1 is arranged on the left side of the partition portion 55, and the second pump chamber P2 is arranged on the right side of the partition portion 55. The first pump chamber P1 has a first intake space L1 which is the space taking in the oil, and a first discharge space H1 which is the space discharging the oil. The first intake space L1 and the first discharge space H1 are spaced away from each other through mesh-engagement between the internal gear 10 and the first external gear 20. The second pump chamber P2 has a second intake space L2 which is the space taking in the oil, and a second discharge space H2 which is the space discharging the oil. The second intake space L2 and the second discharge space H2 are spaced away from each other through mesh-engagement between the internal gear 10 and the second external gear 30.

Here, in the pump chamber P, the first intake space L1 and the second intake space L2 constitute a low pressure region, and the first discharge space H1 and the second discharge space H2 constitute a high pressure region. As a result, on the inner peripheral side of the internal gear 10, there is generated a difference in pressure (high/low pressure difference) between the intake spaces L1, L2 and the discharge spaces H1, H2. In the present embodiment, however, the intake spaces L1 and L2 (the low pressure regions) are arranged in a positional relationship which is symmetrical with respect to the rotation center of the internal gear 10, and the discharge spaces H1 and H2 (the high pressure regions) are arranged in a positional relationship which is symmetrical with respect to the rotation center of the internal gear 10. At this time, the first intake space L1 and the second intake place L2 are set to the same pressure (intake pressure), and the first discharge space H1 and the second discharge space H2 are set to the same pressure (discharge pressure). Thus, the outer direction pressure acting on the inner peripheral surface of the internal gear 10 is offset between the intake spaces L1 and L2 and between the discharge spaces H1 and H2, and an equilibrium is attained in the pressure balance in the internal gear 10, whereby there is exerted a self-alignment action with respect to the internal gear 10 (the motor rotor 41). As a result, it is possible to improve the mechanical efficiency of the gear pump 1.

The front side accommodation portion 53 is a cylindrical accommodation space accommodating the plate member 80. This front side accommodation portion 53 communicates with the intake spaces L1 and L2 and the discharge spaces H1 and H2 via the openings extending through the partition wall portion 54 constituting the boundary portion between the front side accommodation portion 53 and the rear side accommodation portion 52. Formed on the front surface side of the partition wall portion 54 is a recessed-groove-like intake oil path 56 open toward the front side. This intake oil path 56 is formed as an intake space communication portion 57 integrally connecting between the first intake space L1 and the second intake space L2. This intake oil path 56 (the intake space communication portion 57) distributes the oil taken in from an intake port 71 described below to the first intake space L1 and the second intake space L2. An O-ring (not shown) as a seal member is attached to an annular groove 58 recessed at the front end surface of the case member 50, and this O-ring effects sealing between the case member 50 and the cover member 70 in a liquid-tight fashion.

The body member 60 is formed in a disc-like shape by using a metal material such as aluminum alloy. The body member 60 is mounted to the rear end side of the case member 50 by a bolt (not shown), and closes the opening of the rear side accommodation portion 52. At the front end side of the body member 60, there protrudes a circular spigot portion 61 fit-engaged with the rear side accommodation portion 52 of the case member 50. At the front end surface of the spigot portion 61, there are formed a plurality of recesses 62 in alignment with the sectional configuration of each intake space L1, L2 and each discharge space H1, H2. An O-ring (not shown) as a seal member is attached to an annular groove 63 formed at the root position of the spigot portion 61, and this O-ring effects sealing between the case member 50 and the body member 60 in a liquid-tight fashion.

The cover member 70 is formed in a disc-like shape by using a metal material such as aluminum alloy. The cover member 70 is mounted to the front end side of the case member 50 by a bolt (not shown), and closes the opening of the front side accommodation portion 53. Formed in the cover member 70 are an intake port (intake opening) 71 for taking in the oil from the outside and a discharge port (discharge opening) 72 for discharging the oil to the exterior so as to extend therethrough in the front-rear direction. At the rear end side of the cover member 70, there protrudes a circular spigot portion 73 fit-engaged with the front side accommodation portion 53 of the case member 50.

The plate member 80 is formed in a disc-like shape by using a metal material such as aluminum alloy. The plate member 80 is formed in a size allowing accommodation in the front side accommodation portion 53 of the case member 50. Its front side end surface abuts the rear side end surface (spigot portion 73) of the cover member 70, and its rear side end surface abuts the end surface on the front side of the partition wall portion 54 of the case member 50. The plate member 80 is provided with an intake oil path 81 communicating with the intake port 71 of the cover member 70, and a discharge oil path 82 communicating with the discharge port 72 of the cover member 70. The intake oil path 81 has an intake communication groove 81*a* open toward the front side and connected to the intake port 71 of the cover member 70, and an intake communication hole 81*b* formed so as to extend therethrough in the front-rear direction and connected to the intake oil path 56 (intake space communication portion 57) of the case member 50. This intake oil path 81 exhibits a positional relationship in which, when seen from the front-rear direction, the intake communication groove 81*a* overlaps the intake port 71 of the cover member 70, and in which the intake communication hole 81*b* overlaps the intake space communication portion 57 of the case member 50. The discharge oil path 82 has a discharge communication groove 82*a* open toward the front side and connected to the discharge port 72, a first discharge communication hole 82*b* extending therethrough in the front-rear direction and communicating with the first discharge space H1, and a second discharge communication hole 82*c* extending therethrough in the front-rear direction and communicating with the second discharge space H2. This discharge oil path 82 exhibits a positional relationship in which, when seen from the front-rear direction, the discharge communication groove 82*a* overlaps the discharge port 72 of the cover member 70, and in which the first discharge communication hole 82*b* and the second discharge communication hole 82*c* respectively overlap the first discharge space H1 and the second discharge space H2 of the case member 50. This discharge oil path is formed as a discharge space communication portion 83 integrally connecting between the first discharge space H1 and the second discharge space H2. This discharge oil path 82 (discharge space communication portion 83) joins the oil discharged from the first discharge space H1 and the oil discharged from the second discharge space H2. That is, in the present embodiment, the intake oil path 56 (intake space communication portion 57) of the case member 50 is formed as a distribution oil path distributing the oil, and the discharge oil path 82 (discharge space communication portion 83) of the plate member 80 is formed as a joining oil path joining the oil.

Although not shown, the gear pump 1 according to the present embodiment is formed as a canned motor pump having inside the case member 50 a can (partition member) isolating the motor rotor 41 and the motor stator 42 from each other. The can is formed in a cylindrical configuration by using a non-magnetic material so as not to hinder the transmission of an electromagnetic force from the motor stator 42 to the motor rotor 41. Inside the rear side accommodation portion 52, the can divides the outer peripheral side space (the space where the motor stator 42 is arranged) and the inner peripheral side space (the space where the motor rotor 41 is arranged) from each other in a liquid-tight state.

Next, the operation of the gear pump 1 according to the present embodiment will be described. First, when the motor stator 42 (coil 45) is energized, and the motor rotor 41 and the internal gear 10 are integrally rotated in the direction of the arrow X of FIG. 3, the external gears 20 and 30 in mesh-engagement with the internal gear 10 are caused to rotate in the direction of the arrow Y in FIG. 3. When the internal gear 10 and the external gears 20 and 30 rotate while in mesh-engagement with each other, the oil from the outside is taken in from the intake port 71 by the pump action of the gears 10, 20, and 30. The oil introduced into the intake port 71 flows via the intake oil path 81 and is distributed at the intake oil path 56 (intake space communication portion 57) to flow into the first intake space L1 of the first pump chamber P1 and into the second intake space L2 of the second pump chamber P2.

With the rotation of the internal gear 10 and the first external gear 20, the oil taken into the first intake space L1 fills the inter-tooth space 22 of the first external gear 20, and is transferred to the first discharge space H1 while confined in the inter-tooth space 22, and, at the same time, fills the inter-tooth space 12 of the internal gear 10, and is transferred to the second discharge space H2 while confined in the inter-tooth space 12. On the other hand, with the rotation of the internal gear 10 and the second external gear 30, the oil taken into the second intake space L2 fills the inter-tooth space 32 of the second external gear 30, and is transferred to the second discharge space H2 while confined in the inter-tooth space 32, and, at the same time, fills the inter-tooth space 12 of the internal gear 10, and is transferred to the first discharge space H1 while confined in the inter-tooth space 12.

The oil transferred to the discharge spaces H1 and H2 is discharged from the discharge spaces H1 and H2 by the pump action of the gears 10, 20, and 30. The oil discharged from the first discharge space H1 and the oil discharged from the second discharge space H2 join at the discharge oil path 82 (discharge space communication portion 83), and is discharged to the exterior from the discharge port 72.

When the internal gear 10 and the external gears 20 and 30 thus rotate, the oil is taken into the intake spaces L1 and L2 attaining low pressure as a result of the tooth surfaces being mutually spaced away from each other in accordance with the rotation, and the oil is discharged from the discharge spaces H1 and H2 attaining high pressure as a result of the tooth surfaces coming into close proximity with each other. From this onward, in response to the rotation of the gears 10, 20, and 30, the oil intake operation and the oil discharge operation are repeated.

In the gear pump 1 according to the present embodiment described above, of the intake side and discharge side oil path structures, the intake oil path 56 (intake space communication portion 57) establishing communication between the intake spaces L1 and L2, and the discharge oil path 82 (discharge space communication portion 83) establishing communication between the discharge spaces H1 and H2, are formed separately in the case member 50 and the plate member 80, whereby it is possible to realize, by using solely the single plate member 80, an oil path structure which distributes the oil from the single intake port 71 to a plurality of intake spaces L1 and L2 and which joins the oil from a plurality of discharge spaces H1 and H2 at the single discharge port 72. Thus, in the gear pump 1 according to the present embodiment, it is possible to form this plate member 80 in a large thickness (corresponding to a plurality of conventional plate members) to secure a larger oil path area than in the prior art, so that it is possible to achieve a reduction in the pressure loss of the oil and to improve the pump performance.

The present invention is not restricted to the embodiment described above but allows improvement as appropriate without departing from the scope of the gist of the present invention.

While in the above-described embodiment the intake space communication portion 57 connecting the intake spaces L1 and L2 is provided in the case member 50, and the discharge space communication portion 83 connecting the discharge spaces H1 and H2 is provided in the plate member 80, this should not be construed restrictively. It is also possible to provide the intake space communication portion 57 in the plate member 80, and to provide the discharge space communication portion 83 in the case member 50. For example, the gear pump 1 of the above-described embodiment is a bidirectional pump in which the intake side and the discharge side are exchanged through the normal/reverse rotation of the electric motor 40 (internal gear 10), so that when the internal gear 10 is rotated in the direction opposite the arrow X direction, each intake space L1, L2 and each discharge space H1, H2 are exchanged (the intake port 71 and the discharge port 72 are exchanged), whereby the intake space communication portion and the discharge space communication portion are exchanged and reversed. As a result, in the gear pump 1 of the above-described embodiment, the intake side communication portion is provided in the plate member 80, and the discharge side communication portion is provided in the case member 50. In this way, one of the intake space communication portion and the discharge space communication portion corresponds to one side communication portion as defined in the claims, and the other of the intake space communication portion and the discharge space communication portion corresponds to the other side communication portion as defined in the claims.

While in the above-described embodiment the first external gear 20 and the second external gear 30 of the same configuration including the outer diameter and the number of teeth are adopted, this should not be construed restrictively. For example, it is also possible to adopt a first external gear 20 and a second external gear 30 of different configurations including the outer diameter and the number of teeth.

While in the above-described embodiment the gear pump of the present invention is applied to an electric gear pump, this should not be construed restrictively. For example, it is also applicable to a mechanical gear pump in which one of a pair of external gears is rotated by a drive source such as an engine. Further, the gear pump of the present invention is not restricted to an oil pump but can also be applied to some other fluid pump such as an air pump or a water pump.

EXPLANATION OF NUMERALS AND CHARACTERS

1 gear pump
10 internal gear
11 internal tooth
12 inter-tooth space
20 first external gear
21 external tooth
22 inter-tooth space
30 second external gear
31 external tooth
32 inter-tooth space
40 electric motor
41 motor rotor
42 motor stator
50 case member
52 rear side accommodation portion (one end side accommodation portion)
53 front side accommodation portion (the other end side accommodation portion)
54 partition wall portion
55 partition portion
56 intake oil path
57 intake space communication portion (one side communication portion)
60 body member
70 cover member
71 intake port (first port)
72 discharge port (second port)
80 plate member
81 intake oil path (first communication path)
81*a* intake communication groove
81*b* intake communication hole
82 discharge oil path (second communication path)
82*a* intake communication groove (communication groove)
82*b* intake communication hole (communication hole)
82*c* intake communication hole (communication hole)
83 discharge space communication portion (the other side communication portion)
P pump chamber
P1 first pump chamber
P2 second pump chamber
L1 first intake space (one space)
L2 second intake space (one space)
H1 first discharge space (the other space)
H2 second discharge space (the other space)

The invention claimed is:

1. A gear pump comprising:

an internal gear having internal teeth on an inner peripheral side;

a first external gear and a second external gear having external teeth arranged on the inner peripheral side of the internal gear and having mesh-engagement with the internal teeth;

a case member having a one end side accommodation portion at one end side in an axial direction rotatably accommodating and retaining the internal gear, the first external gear and the second external gear and having an other end side accommodation portion at other end side in the axial direction, the case member having a partition wall portion between the one end side accommodation portion and the other end side accommodation portion;

a cover member mounted to the case member and closing an opening of the other end side accommodation portion;

a plate member accommodated in the other end side accommodation portion of the case member, and a pump chamber being defined inside the one end side accommodation portion and inside the internal gear, wherein the case member has a partition portion dividing the pump chamber into a first pump chamber arranged on a side of the first external gear and a second pump chamber arranged on a side of the second external gear;

the first pump chamber has a first intake-discharge space taking in or discharging fluid and a first discharge-intake space discharging or taking in fluid in accordance with relative rotation of the internal gear and the first external gear;

the second pump chamber has a second intake-discharge space taking in or discharging fluid and a second discharge-intake space discharging or taking in fluid in accordance with relative rotation of the internal gear and the second external gear;

the first intake-discharge space, the second intake-discharge space, the first discharge-intake space and the second discharge-intake space communicate with the other end side accommodation portion through the partition wall portion;

the cover member has a first port and a second port;

the plate member has a first communication path communicating with the first port and a second communication path communicating with the second port are formed between the plate member and the cover member;

a one side communication passage, which communicate the first intake-discharge space with the second intake-discharge space, is formed between the plate member and the partition wall portion;

the one side communication passage is communicated with the first communication path through a penetrating hole which penetrate the plate member;

two penetrating holes, which communicate the second communication path with the first discharge-intake space and the second discharge-intake space, are formed on the plate member, and an other side communication passage, which communicate the two penetrating holes with each other, is formed between the plate member and the cover member.

2. The gear pump according to claim 1, wherein the one side communication passage is a first groove formed on the partition wall portion and covered by the plate member, the first groove communicates the first intake-discharge space with the second intake-discharge space, and the other side communication passage is a second groove formed on the plate member and covered by the cover member, the second groove communicates the two penetrating holes with each other.

3. The gear pump according to claim 1, wherein the first intake-discharge space and the second intake-discharge space are arranged symmetrically with respect to a rotation center of the internal gear; and the first discharge-intake space and the second discharge-intake space are arranged symmetrically with respect to the rotation center of the internal gear.

4. The gear pump according to claim 1, wherein the first port is an intake port for taking in the fluid;

the second port is a discharge port for discharging the fluid;

fluid from the intake port is distributed to the first intake-discharge space and the second intake-discharge space at the one side communication portion; and the fluid from the first discharge-intake space and the second discharge-intake space is joined at the other side communication portion to be sent to the discharge port.

* * * * *